US007188741B1

(12) United States Patent
Abdi et al.

(10) Patent No.: US 7,188,741 B1
(45) Date of Patent: Mar. 13, 2007

(54) OVER THE DOOR SUPPORT APPARATUS

(75) Inventors: Abraham Abdi, Orange, CA (US); Charles L. Coulter, Riverside, CA (US); Terry Lee Oster, Temecula, CA (US)

(73) Assignee: Merrick Engineering, Inc, Corona, CA (US)

( * ) Notice: Subject to any disclaimer, the term of this patent is extended or adjusted under 35 U.S.C. 154(b) by 116 days.

(21) Appl. No.: 10/917,437

(22) Filed: Aug. 13, 2004

(51) Int. Cl.
*D06F 53/00* (2006.01)

(52) U.S. Cl. ..... 211/119.004

(58) Field of Classification Search ..... 211/119.004, 211/118, 204, 16, 119.009, 113, 88.04, 85.29
See application file for complete search history.

(56) References Cited

U.S. PATENT DOCUMENTS 4,518,089 A * 5/1985 Campbell ..... 211/118
4,901,871 A * 2/1990 Ohm et al. ..... 211/119.004
5,855,279 A * 1/1999 Klein et al. ..... 211/35
6,138,841 A * 10/2000 Klein et al. ..... 211/85.7
6,152,313 A * 11/2000 Klein et al. ..... 211/113
6,257,425 B1 * 7/2001 Liu ..... 211/90.01
6,533,127 B1 * 3/2003 Klein et al. ..... 211/35
6,637,603 B2 * 10/2003 Klein et al. ..... 211/35
6,793,080 B2 * 9/2004 Klein et al. ..... 211/35
6,877,615 B2 * 4/2005 Klein et al. ..... 211/35
6,926,157 B2 * 8/2005 Klein et al. ..... 211/35
7,021,475 B2 * 4/2006 Klein et al. ..... 211/35

* cited by examiner

*Primary Examiner*—Sarah Purol
(74) *Attorney, Agent, or Firm*—G. Donald Weber, Jr.

(57) ABSTRACT

A hanging apparatus adapted to be mounted over the top of a door or other support structure. The apparatus is spaced outwardly from and substantially parallel to the surface of the support structure to provide a support for towels, linens, garments and the like.

8 Claims, 2 Drawing Sheets

OVER THE DOOR SUPPORT APPARATUS

BACKGROUND OF THE INVENTION

1. Field of the Invention

This apparatus is related to a hanging apparatus, in general, and to a hanging apparatus which is adapted to hang from the top of a door or similar support structure, in particular.

2. Prior Art

There are many over-the-door storage and/or hanging devices known in the art. These devices include brackets which mount over the door and provide a support for items such as hangers or the like. Also, these types of devices include multiple pockets or supports for retaining shoes or the like. Typically, the shoe supports are fixed in position while the pocket units may collapse into a small dimension. However, the hanger supports are usually fairly rigid and extend outwardly from the door.

These hanger support devices may take the form of a small hook which supports one or two items or a larger bracket which extends substantially perpendicular to the door surface for supporting multiple hangers or similar devices substantially parallel to the surface of the door. In some cases, these hooks and/or brackets can be pivotally mounted in an over-the-door clip or attachment whereby the door can be placed close to a wall when the hook or bracket is not being used. However, the length of this pivotally mounted hook or bracket is limited to one half the width of the door which limits the number of hangers which can be supported. Likewise, the hook or bracket is cantilevered from the door surface which limits the weight of the goods which can be hung on the bracket unless the bracket is made of relatively heavy, strong material such as metal rods, or the like.

SUMMARY OF THE INSTANT INVENTION

A hanging apparatus adapted to be mounted over the top of a door, divider wall or similar support structure. The hanging apparatus extends slightly outwardly from the surface of the support structure to provide a mechanism for hanging towels, linens or the like substantially flat against or adjacent to the surface of the support structure. The hanging apparatus includes a pair of main support rails which may include a curved configuration and at least one horizontal support bar. A unique connecting boss is formed on the support rails to receive the support bars.

DESCRIPTION OF A PREFERRED EMBODIMENT

Figure 1:
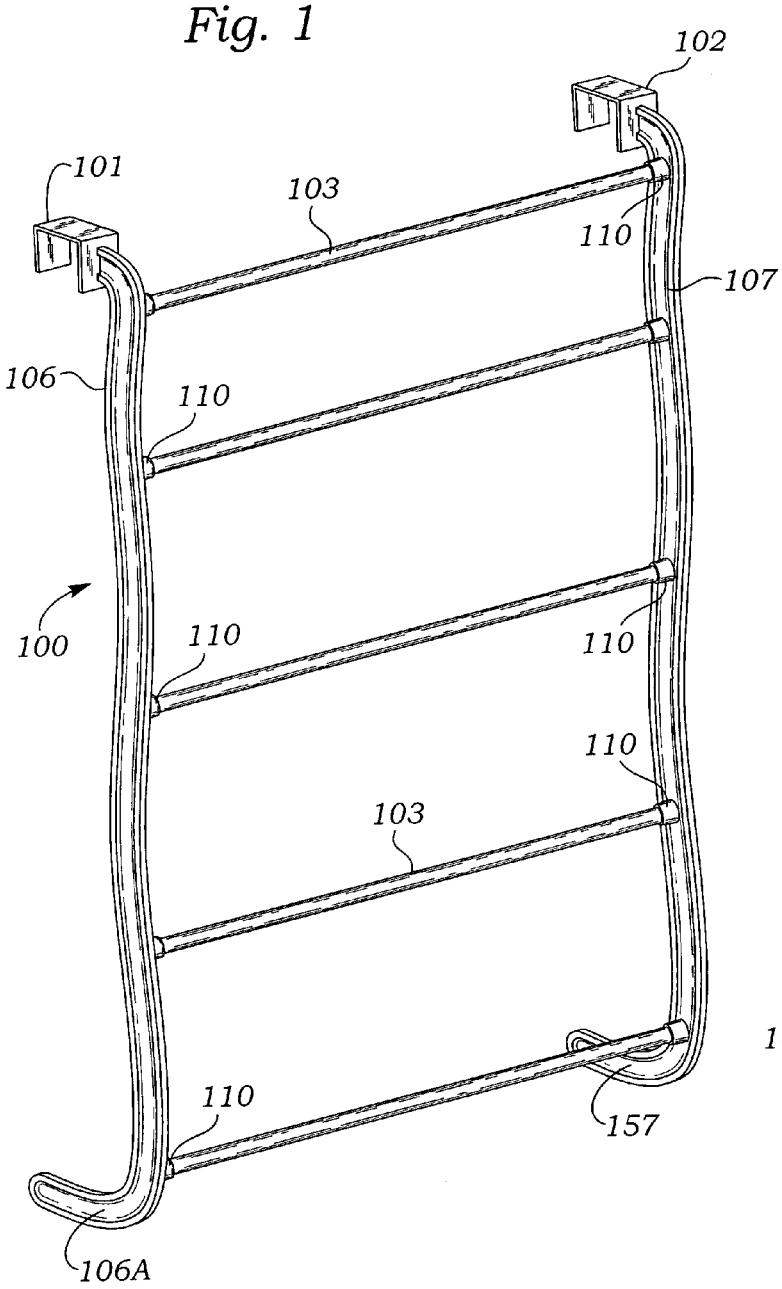
FIG. 1 is a perspective view of the assembled hanging apparatus.

Referring now to FIG. 1, there is shown a perspective view of hanging apparatus 100 of the instant invention in the assembled and operating state. The apparatus 100, sometimes referred to as an over-the-door towel valet, includes hooks 101 and 102 for engaging the top of a conventional door or other support structure (not shown).

The hooks 101 and 102, as shown, are preferably formed of a unitary component with three sides in the form of an inverted U-shape. Two of the sides are substantially parallel to each other but may be tapered toward each other, if so desired, in order to grip the support structure. A third side of the hook (connected between the ends of the other two sides) is substantially flat or planar. This configuration permits the hanging apparatus to largely conform with the top of the support structure. For example, a supporting structure in the form of a door is able to close properly with the hanging apparatus 100 mounted thereon.

The hooks 101 and 102 can be formed of any suitable material, such as plastic, metal or the like, with the appropriate structural strength to support the hanging apparatus 100 and the items supported thereby.

In the preferred embodiment, the upper ends of support rails 106 and 107 are integrally formed with the hooks 101 and 102, respectively. The support rails 106 and 107 are shown formed in a somewhat sinuous or curved lengthwise configuration. This shape is desirable in order to provide structural strength as well as a cosmetically pleasing design. The shape is advantageous to assure that the lower ends of the support rails 106 and 107 and, thus, the overall apparatus 100 are positioned close to but spaced away from the supportive door or other structure. The lower ends 106A and 107A, respectively, of support rails 106 and 107 are preferably rounded but can be flat or any suitable configuration to avoid marring the surface of the supporting structure.

The support rails 106 and 107 are, typically about 32 inches long and the lower ends 106A and 107A are about 4 inches long. These dimensions are illustrative only and are not intended to be limitative of the invention. The support rails are, typically, fabricated of a suitable material such as plastic, metal or the like.

The support rails 106 and 107 have a generally I-beam configuration with a relatively thin center and enlarged edges. The cross-section of the support rails provides strength while maintaining a lightweight and desirable design.

A plurality of bosses 110 are provided on the inner surface of each support rail. The bosses (in the form of receptacles) receive the ends of the horizontal support bars 103.

The horizontal support bars 103 can be fabricated of plastic, metal or any suitable material and may be solid rods or hollow bars. The width of the apparatus 100 can be altered by selecting the length of support bars 103.

Figure 2:
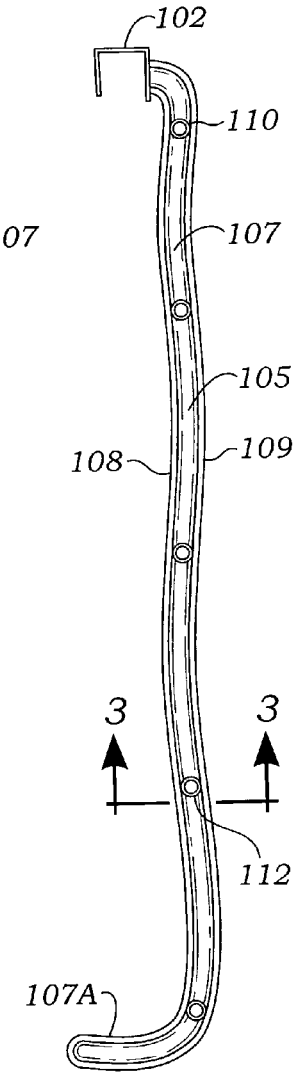
FIG. 2 is an inner plan view of a main support rail of the hanging apparatus with a plurality of bosses thereon.

Referring now to FIG. 2, there is shown an interior side view of support rail 107 with the attached hook 102. (Support rail 106 with hook 101 is the mirror image.)

The support rail 107 includes edges or flanges 108 and 109 joined to the central web 105 to form the configuration described supra. It is understood that the so-called I-beam configuration with rectilinear web 105 and flanges 108 and 109 is desirable but, is not a required feature of the invention, as discussed infra.

A plurality of bosses 110 are formed in spaced apart locations in the rail 107 as shown in FIG. 2. (Counterpart bosses 110 are formed in rail 106 as seen in FIG. 1.) The bosses 110 are provided to receive and secure the outer ends of horizontal support bars 103 as shown in FIG. 1. The bosses are integrally formed with the support rails as described infra. While not limited thereto, the spacing between bosses is, typically, about 6 to 8 inches to permit advantageous use of the hanging apparatus.

Figure 3:
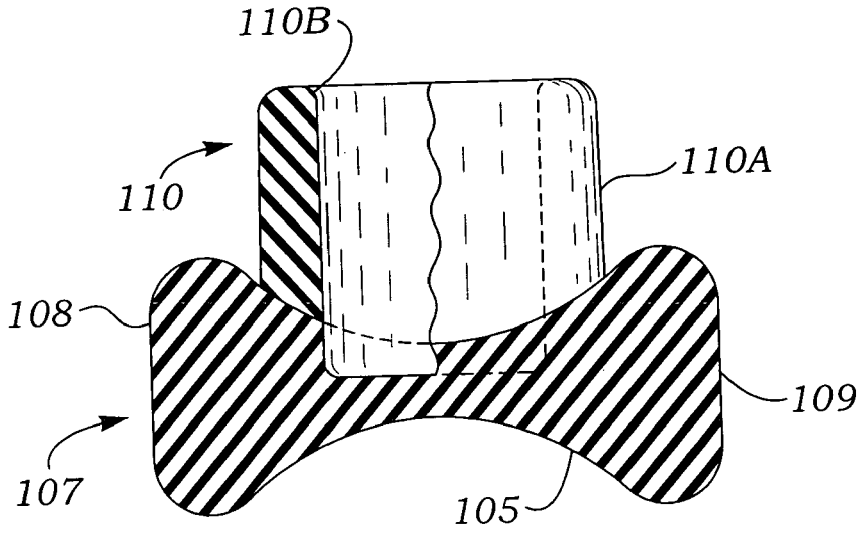
FIG. 3 is an enlarged cross-sectional view of a portion of a main support rail with a boss thereon.

Referring now to FIG. 3, there is shown a partially broken away side view of a boss 110 as formed with rail 107. This formation is representative of all boss/rail configurations in the apparatus of the instant invention.

In this embodiment, the edges or flanges 108 and 109 with the central web 105 of rail 107 are shown in a curvilinear configuration (sometimes referred to as a "dog-bone" shape) which is advantageous for structural and manufacturing reasons.

The boss 110 is, typically, integrally molded with rail 107. The boss 110 comprises a tapered conical outer surface 110A and a substantially right cylindrical internal cavity 402 (see FIG. 4) defined by inner surface 110B. The interior base 110C of the boss is, generally, a flat, circular surface.

In this embodiment, the peripheral dimension at the outer end of boss 110 is smaller than the peripheral dimension of the boss at the inner end (i.e., nearest to or at the rail 107) dimension while the inner diameter dimension of the cavity is substantially constant to provide an easily manufactured device with advantageous functionality as described infra.

Figure 4:
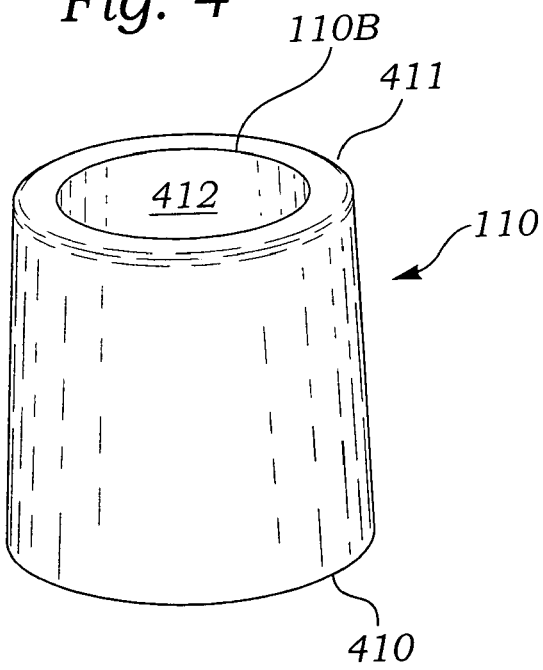
FIG. 4 is an enlarged view of a boss separate from the rail.

Referring now to FIG. 4, there is shown an enlarged, perspective view of a boss 110 separated from the apparatus for illustrative purposes. As noted, the boss 110 has a tapered, generally, conical exterior configuration with a base 410 which has a larger diameter than the top 411. The cavity 412 defined by inner surface 110B (see also FIG. 3) is, essentially, a right cylinder with a substantially constant diameter for receiving the ends of the horizontal support bars 103 as shown in FIG. 1.

The noted configuration of the bosses 110 has the desirable effect of providing a relatively thin wall at the outer end or top 411 of the boss 110 whereby the outer end of the boss is somewhat deformable, if necessary, to insert the end of the support bar 103 while initially assembling the apparatus.

By gently forcing the support bar 103 into the boss 110, the bar encounters the thicker, more rigid interior end or base 410 of the boss 110. The rigid interior end of the boss 410 provides extra support for and frictional retention of the bar 103. The slightly softer, more pliant outer end of the boss engages the end of the support bar with a significant frictional gripping effect. Nevertheless, when desired, the support bar 103 can be readily removed (by a twisting action for example) from the boss 110.

Thus, there is shown and described a unique design and concept of a hanging apparatus which is selectively mounted to a support structure. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A hanging apparatus adapted to hang from a structure comprising, first and second support rails, each of said first and second support rails having at least two curved sections along the length thereof, first and second hooks for engaging a structure, one end of each of said first and second hooks integrally formed with one end of each of said first and second support rails, respectively, such that said first and second support rails are spaced away from the structure, at least one boss integrally formed on an inwardly facing surface of each of said first and second support rails, each said boss has a first outer peripheral dimension adjacent the respective rail and a second outer peripheral outer peripheral dimension spaced away from said respective rail wherein said second outer peripheral dimension is smaller than said first outer peripheral dimension, each said boss includes a substantially right cylindrical cavity therein, and at least one support bar inserted into the boss on each of said first and second support rails.

2. The apparatus recited in claim 1 including, a second end of each of said first and second support rails disposed at an angle to the respective support rail in order to bear against the structure and cause said first and second support rails to be spaced away from the structure.

3. The apparatus recited in claim 1 wherein, said first and second support rails are fabricated of a suitable material such as plastic, metal or the like.

4. The apparatus recited in claim 1 wherein, said boss includes a tapered configuration with a smaller peripheral dimension at the open top end thereof.

5. The apparatus recited in claim 1 wherein, each of said first and second support rails has a relatively thin center portion and enlarged edges.

6. The apparatus recited in claim 5 wherein, each boss is formed at said thin center portion between said enlarged edges.

7. The apparatus recited in claim 1 wherein, each of said first and second hooks has an inverted U-shape.

8. The apparatus recited in claim 1 wherein, said boss has a relatively thin, pliant outer end and a relatively thick, rigid inner end.

* * * * *